US006497643B1

(12) United States Patent
Hartmann et al.

(10) Patent No.: US 6,497,643 B1
(45) Date of Patent: Dec. 24, 2002

(54) FORMER

(75) Inventors: Manfred Wolfgang Hartmann, Elfershausen (DE); Horst Bernhard Michalik, Höchberg (DE); Wolfgang Günter Ruckmann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/623,466

(22) PCT Filed: Mar. 13, 1999

(86) PCT No.: PCT/DE99/00698

§ 371 (c)(1),
(2), (4) Date: Sep. 13, 2000

(87) PCT Pub. No.: WO99/47445

PCT Pub. Date: Sep. 23, 1999

(30) Foreign Application Priority Data

Mar. 13, 1998 (DE) ..... 198 11 109

(51) Int. Cl.[7] ..... B31B 1/26

(52) U.S. Cl. ..... 493/458; 493/416; 493/423; 493/438

(58) Field of Search ..... 493/458, 416, 493/423, 438, 436, 441, 450, 432

(56) References Cited

U.S. PATENT DOCUMENTS 2,754,113 A * 7/1956 Sjostrom
4,490,132 A * 12/1984 Ogura et al. ..... 493/432
4,516,759 A * 5/1985 Kobler
4,682,977 A * 7/1987 Buxton ..... 493/423
5,030,193 A 7/1991 Breton et al.
5,037,368 A 8/1991 Breton et al.
5,049,123 A 9/1991 Breton et al.
5,344,379 A * 9/1994 Garrone ..... 493/441

FOREIGN PATENT DOCUMENTS

| | | |
|---|---|---|
| DE | AS 1141650 | 5/1960 |
| DE | 196 12 924 | 4/1996 |
| EP | 0415 077 A1 | 7/1990 |
| GB | 862296 | 3/1961 |
| JP | 062487622 | 9/1994 |

* cited by examiner

*Primary Examiner*—Eugene Kim
*Assistant Examiner*—Sameh Tawfik
(74) *Attorney, Agent, or Firm*—Jones, Tullar & Cooper, P.C.

(57) ABSTRACT

A former is used to fold webs longitudinally. During the web drawing-in process; the individually incoming paper webs in a group of paper webs are conveyed smoothly to a folding mechanism at the end of the former. This is accomplished by using a number of upper and lower transport elements which are located above and next to each other at least inside the boundaries of the upper surface of the former. These upper and lower transport elements can be brought together and can be separated. They can be driven as desired.

9 Claims, 6 Drawing Sheets

FORMER

FIELD OF THE INVENTION

The present invention relates to a former for the longitudinal folding of one or more webs placed on top of each other. Conveying means for guiding the webs are arranged in the former.

DESCRIPTION OF THE PRIOR ART

A device for the automatic feeding of a start of a paper web is known from DE 196 12 924 A1, wherein the paper web is guided over turning bars or is fed to a former by means of endless driven conveyor belts.

DE-AS 11 41 650 describes a former with conveying rollers for webs of material.

JP 06-247622 A discloses a former with rotating guide elements for reduction of the friction between the former and the web.

GB 862 296 A and EP 0 415 077 A1 each disclose a former with driven conveying means located in the interior. These conveying means convey sheets or webs in the conveying plane of the not yet folded sheets or webs.

SUMMARY OF THE INVENTION

The object of the present invention is based on providing a former.

This object is attained by providing driven conveying means which guide the web to the former. The web or the several webs placed on top of each other are longitudinally folded in the former. The driven conveying means guide the web parallel with the plane of the not yet folded web and are adjacent and also inside the former.

The advantages which can be achieved by means of the present invention lie, in particular, in that in the course of the draw-in process of a paper web into the web-fed rotary printing press, the paper webs of a paper web train are automatically fed to the folding unit. Introduction or re-introduction of individual paper webs can take place at the speed of the press. In the course of this, the paper webs are each guided with prestress between conveyor belts or conveying devices. These conveying devices act on both sides of the outer paper web, so that the interiorly located paper webs are carried along, clamped by the conveyor belts or conveying devices. A displacement of the paper webs themselves and therefore a blockage in the area of the former inlet is avoided by this. It is moreover advantageous that the paper webs can be conveyed up to the folding rollers, even as a train, where they are grasped by the latter and fed to the folding unit.

The paper webs guided by the belt guide devices have a stabilized running direction, so that a lateral excursion, and therefore interruptions of the sequence are prevented. The belt guide device of the present invention can also be employed for removing malfunctions with the running of the webs in the paper web feed device, or in the course of malfunctions with the running of the paper during the draw-in of the paper webs in the folding area.

The conveying means are aligned so they work in, or approximately in, the production direction.

In accordance with a variation of the present invention, lateral guide elements are provided, and extend on both sides of the lateral boundaries of the former surface as far as, or into the vicinity of the respective former roller.

A number of upper and lower conveying means, which are arranged above each other, are provided within the boundaries of the lateral guide elements.

Here, the upper and lower conveying means can be brought into and out of contact with each other and can be selectively driven.

In accordance with a first preferred embodiment of the present invention, a number of conveyor belts, which point in the direction of the surface of the lateral guide elements and which can be charged with suction air, are provided within the boundaries of the lateral guide elements.

In accordance with a second preferred embodiment, the conveying means consist of driven or of non-driven conveying rollers. In this embodiment, the lower and upper driven conveying rollers can act together, for example, or upper conveying rollers can work together with lower suction belts.

In accordance with a third preferred embodiment, the conveying means consist of driven driving or conveying chains.

In accordance with a fourth preferred embodiment, the conveying means can also consist of driven V-belts, flat belts or toothed belts.

A cover, which has slits for the lower conveying means, is suitably provided between the boundaries of the former.

Slits which expose the lower conveying means are also provided in the surfaces of the lateral guide elements.

It is advantageous if an outer paper guide plate is assigned to each of the lateral guide elements and is spaced apart from them. In this configuration, slits are provided in the outer paper guide plate for making access of the upper conveying means to the lower conveying means possible.

It might possibly be sufficient if a paper deflection device, which surrounds the lateral boundaries in the form of a shell, is provided along the lateral boundaries of the former and is spaced apart from them.

It is moreover practical that a paper guide device is provided which is also spaced apart from the former surface and covers it either completely or partially. In this case, the paper guide device arranged in the area of the former surface is provided with suitable slits for making access of the upper conveying means to the lower conveying means possible.

In accordance with a last preferred embodiment, it is also possible that the outer paper guide plate, which covers the lateral guide elements, and the portion of the outer paper guide device covering the former surface, are connected in the area of the lateral deflection elements, or adjoin each other without being connected.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
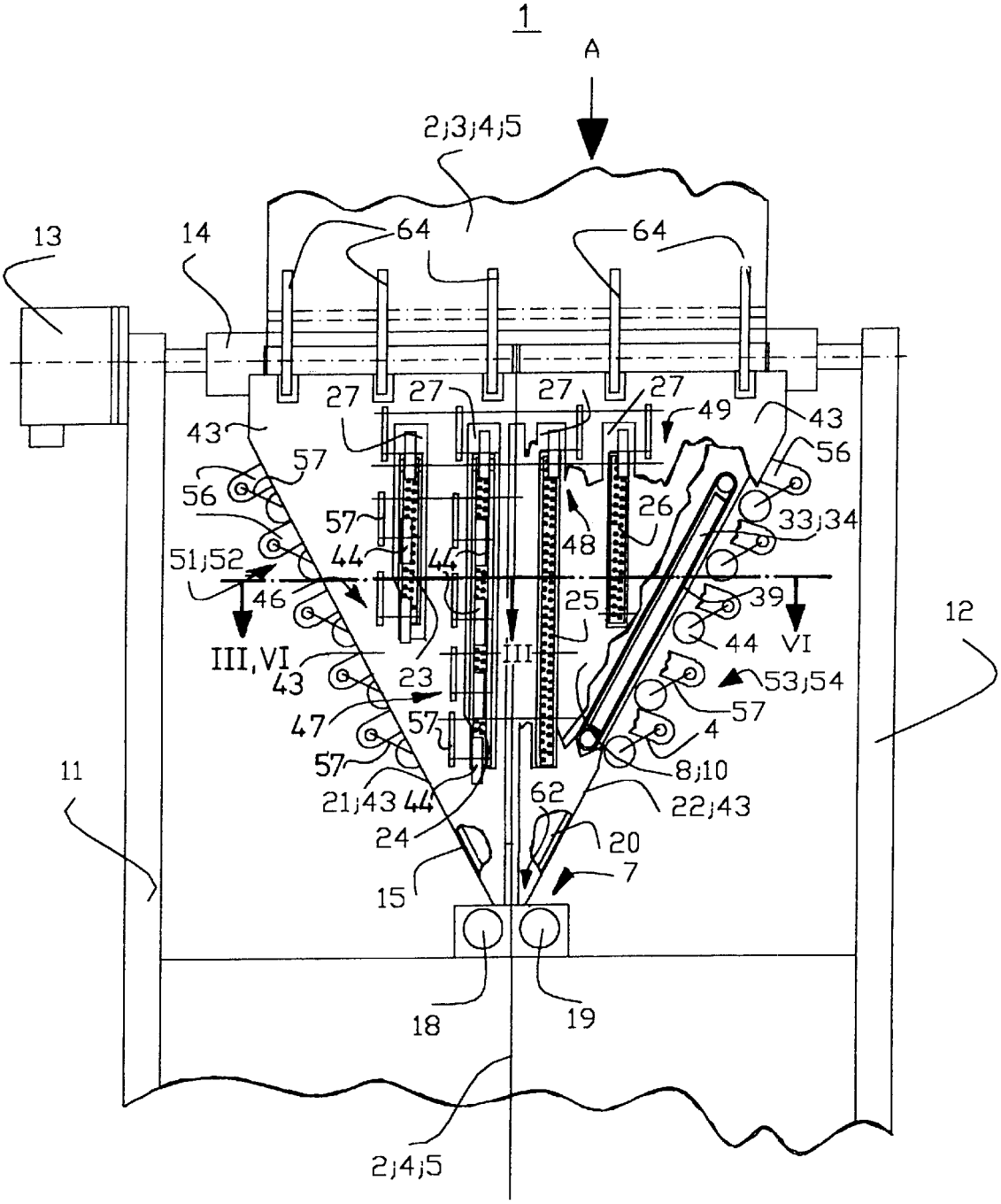
FIG. 1, a front plan view of a former with a paper draw-in system in the position of rest in accordance with the present invention, FIG. 2, a lateral view in accordance with FIG. 1, partially in section, and without the conveying rollers in the left former cheek, FIG. 3, a section view taken along line III—III in FIG. 1, FIG. 4, an enlarged representation of the former outlet in accordance with FIG. 1, FIG. 5, a lateral view of a further preferred embodiment of the conveying devices in the position of rest and, FIG. 6, a sectional representation taken along line VI—VI of FIG. 1 through a longitudinal former analogous to FIG. 3, but with the further variation of the conveying devices and in the working position.
Figure 2:
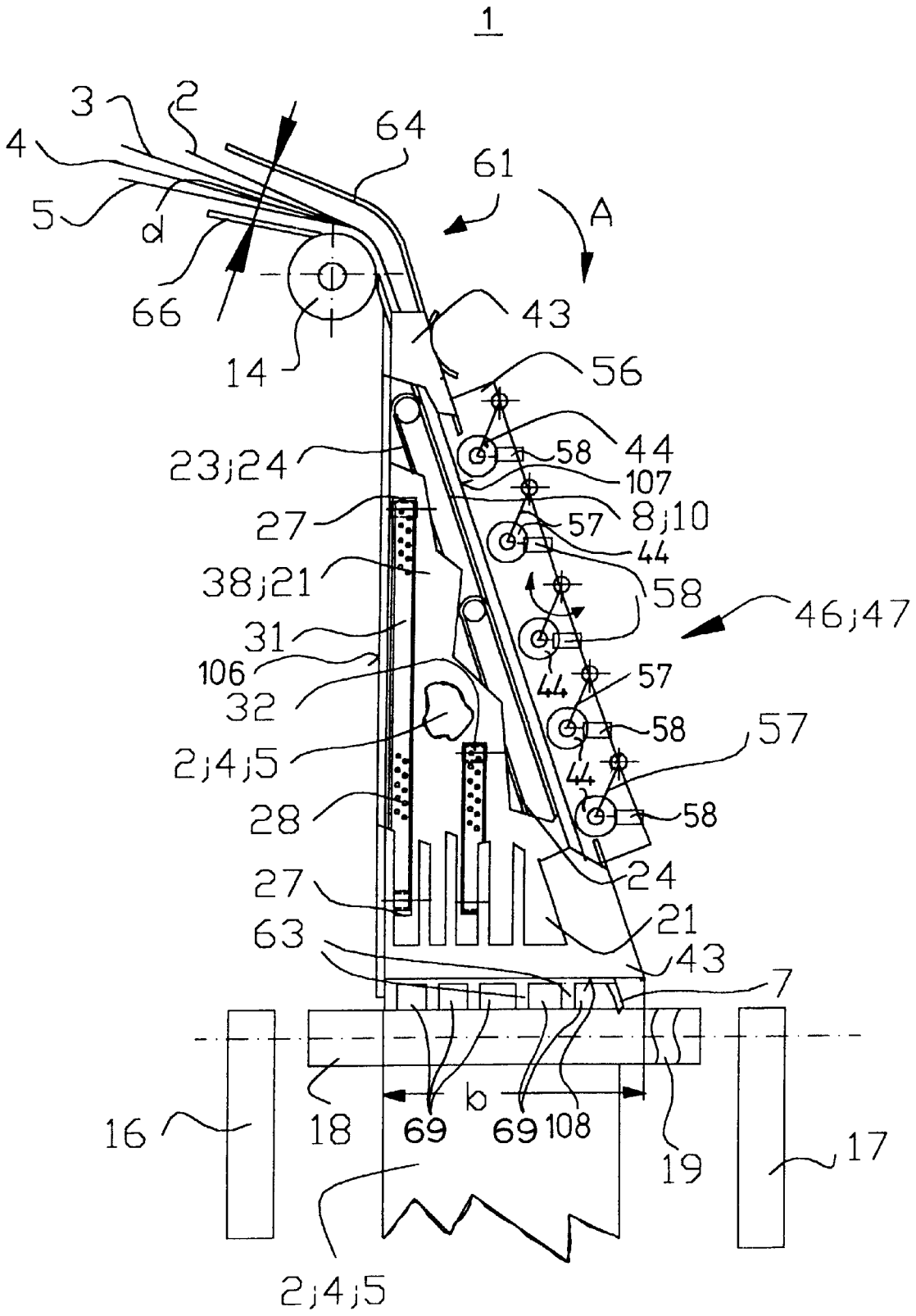
Figure 3:
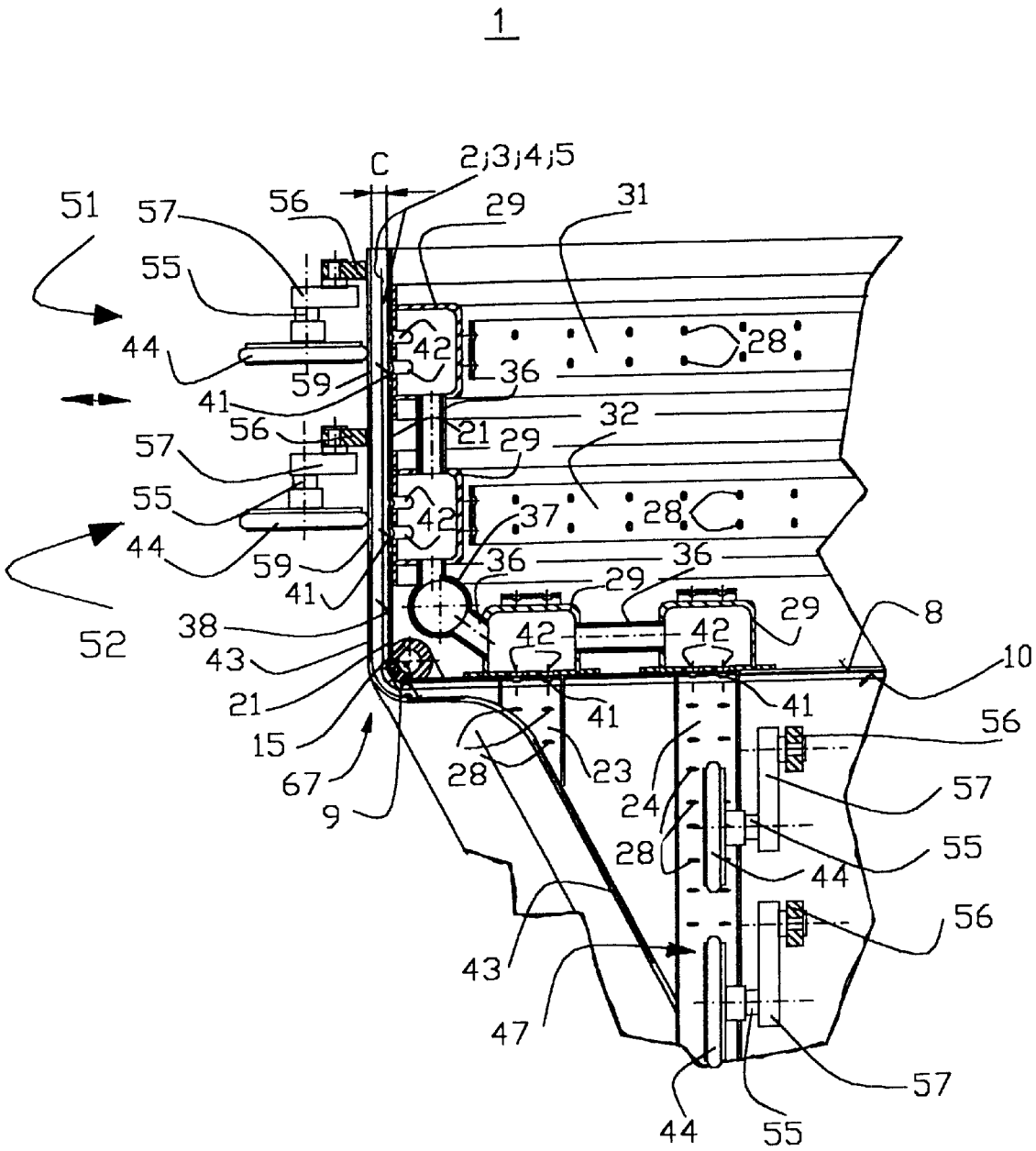
Figure 4:
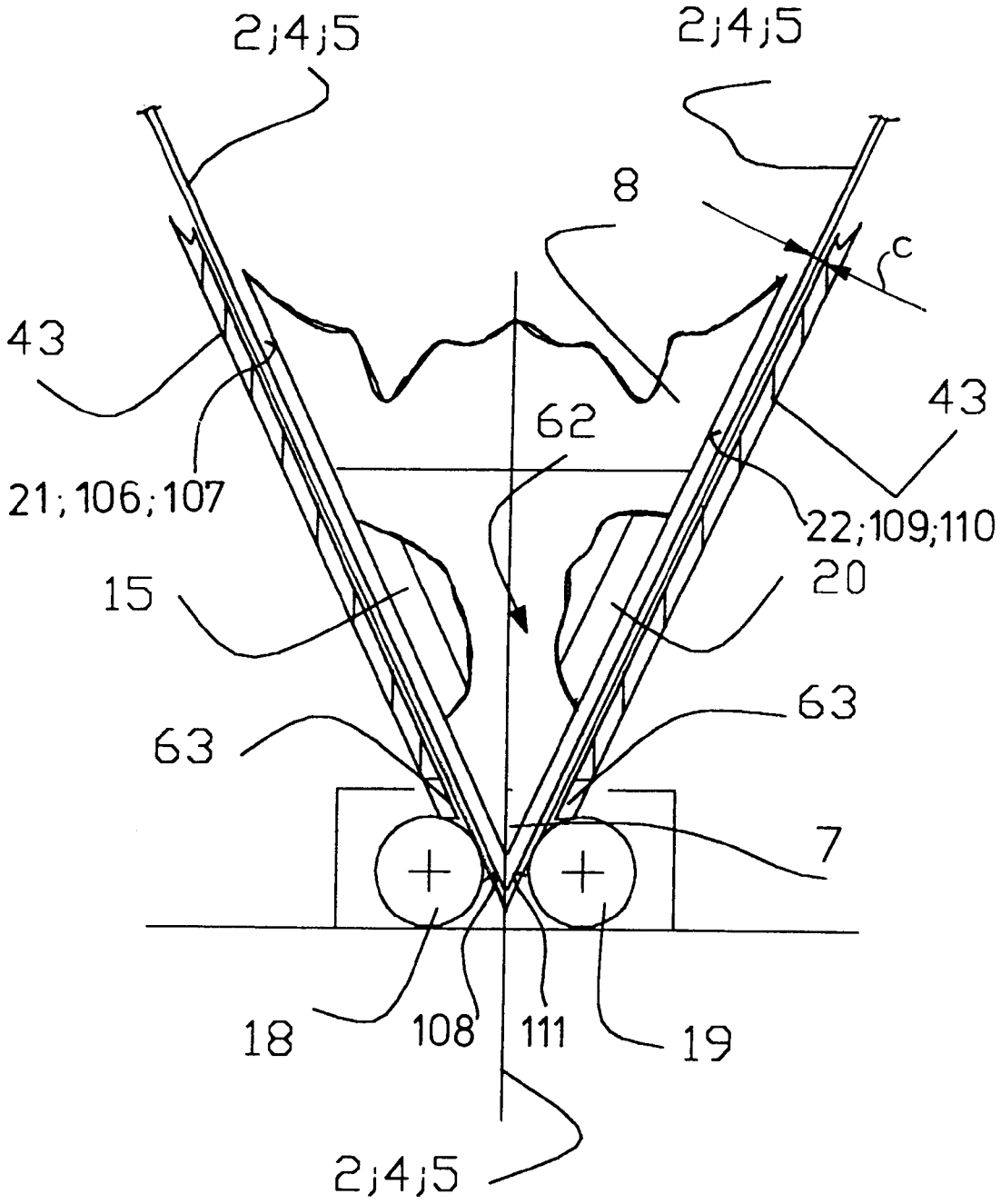

A longitudinal former, identified as former 1 in what follows, is seen in FIG. 1 and for example consists of a triangularly designed former plate 8, which tapers in the running direction of a paper web 2, 3, 4 or 5 in the direction toward the former nose 7 and has a surface 10. The former plate 8 has generally conventional deflecting elements 15, 20, which are arranged on both sides, which can be charged with blown air, and which contain bores 9. The bores 9 in the deflecting elements 15, 20 are directed against the paper webs 2 to 5 inside of a deflecting surface 67 of approximately 90°, as seen in FIG. 3, and which is in the form of a segment of a circle and points in the direction of the paper webs 2 to 5. The deflecting elements 15, 20 consist of a hollow profile, for example a tube, preferably a metal tube. Viewed in the running direction A of the paper webs 2 to 5, a former inlet roller 14 is arranged directly in front of the former inlet, is seated in lateral frames 11, 12 and can be driven by means of a motor 13. Moreover, two known, former folding rollers 18, 19, which are rotatably seated in a frame 16, 17, as seen in FIG. 2, are arranged offset by 90° in relation to the former inlet roller 14 at the end of the former 1 close to the former nose.

In accordance with a first preferred embodiment, left and right lateral guide elements 21, 22, each of which enlarge the former surface and extend parallel with the former folding rollers, are arranged, in addition to the former plate 8, on both sides of the former plate 8 and on the other side of the deflecting elements 15, 20. Each one of the lateral guide elements 21, 22 is designed to be approximately triangular and, viewed in the running direction A of the paper webs 2 to 5, has a maximum width b, as seen in FIG. 2, in the vicinity of the left or right former folding rollers 18, 19. This maximum width b is greater than a maximum width of a longitudinally folded paper web 2 to 5. The lateral guide elements 21, 22 extend in the running direction A of the paper webs 2 to 5. The paper webs 2 to 5 rest against the lateral guide elements 21, 22.

In addition to the former plate 8, the former 1 has at least one lateral guide element 21, 22, which is arranged approximately vertically in relation to the former plate 8.

Driven endless conveying belts 23, 24, 25, 26, for example, are shown in FIG. 1 and are arranged a few millimeters below the surface 10 of the former plate 8. Pairs of these conveyor belts 23 to 26 have different lengths and extend, spaced apart from each other, approximately in the running direction A of the paper webs 2 to 5. The term approximately means, that ends of the conveyor belts 23, 24 which are close to the former folding rollers and are arranged on the left side of the former plate 8 can be offset toward the left by up to 10°, and the conveyor belts 25, 26 on the right side can be arranged mirror-reversed offset toward the right by up to 10°—in relation to the conveying direction A, all as shown in FIG. 1.

By means of respective slits 27 in the surface 10, the conveyor belts 23 to 26 have contact in the direction of the surface 10 and have holes 28. The endless conveyor belts 23 to 26 can be motor-driven and their speed can be controlled, and they are each conducted over belt guide boxes 29.

In accordance with a further preferred embodiment, conveying means also extend at the left and right lateral element 21, 22, for example respectively two conveyor belts 31, 32, 33, 34 conducted on belt guide boxes 29, which are shown in FIG. 3. By means of pipe lines 36, the belt guide boxes 29 are connected with each other, as well as with at least one suction air feed line 37. An upper belt guide surface 41, i.e. facing the surface 10 of the former plate 8 or the surface 38, 39 of the lateral guide elements 21, 22, of each belt guide box 29 has perforations, for example longitudinal slits 42 arranged next to each other and behind each other.

The surfaces 10, 38, 39 of the former plate 8, as well as of the lateral guide elements 21, 22, are surrounded by a paper guide device 43, which is located at a distance c of, for example between 10 and 100 mm, from it, or a paper guide plate of a thin flat material, for example sheet metal, so that a conduit 68 of a width c is formed for receiving the paper webs 2 to 5. In the area near the former folding rollers, the paper guide device 43 can also have slits 69, as seen in FIG. 2.

Conveying roller systems 46 to 49, each having conveying rollers 44, are located above the conveyor belts 23 to 26 of the former plate 8. Furthermore, conveying roller systems 51, 52 and 53, 54 are arranged above the conveyor belts 31, 32 or 33, 34 of the left or right lateral guide elements 21, 22. In FIG. 3, the conveying roller systems 51, 52 are shown in the position of rest. Each of the conveying roller systems 46 to 49 and 51 to 54 have holder brackets 56 fastened on the paper guide device 43, which holder brackets 56 support a number of hinged levers 57. A conveying roller 44 is seated at each free end of the levers 57 by means of shafts 55. Each lever 57 bearing a conveying roller 44 can be pressed against the respectively associated conveyor belt 23 to 26, 31 to 24, for example by means of a controllable work cylinder 58 that is only depicted in FIG. 2. To make possible the contact between the conveying rollers 44 and the conveyor belts 23 to 26, 31 to 34, appropriate cut-outs or slits 59 have been cut into the jacket-like paper guide device 43.

The paper guide device 43 can also consist of a grating, for example a fine-meshed wire grille, arranged at a distance c above the surfaces 10, 38, 39.

The respective conveying roller systems 46 to 49, 51 to 54 can also be designed in such a way that all conveying rollers 44 of a system can be placed against the conveyor belts 23 to 26, 31 to 34 by means of a common actuating means.

The former 1 furthermore has a paper web feed device 61 in the area of the former inlet roller 14. This paper web feed device 61 is arranged upstream of the former 1, as viewed in the running direction A of the paper webs 2, 3, 4, 5, all as shown in FIG. 2. This paper web feed device 61 can consist of upper and lower guide tongues 64, 66, also as shown in FIG. 2, which extend at a distance d, for example 50 to 250 mm, from each other in the running direction A of the paper webs 2 to 5. These guide tongues 64, 66 are guided around the former inlet roller 14 approximately at a radius of the former inlet roller 14 and an arc of wrap of between 30° to 90°. The guide tongues 64, 66 are arranged respectively spaced apart next to each other in the axial direction of the former inlet roller 14.

On their ends near the former folding rollers, each of paper guide devices 43 arranged above the lateral guide elements 21, 22 has several paper web guide tongues 63, which project into the former folding roller inlet nip 62. Forced guidance of the paper webs 2 to 5 into the former folding rollers 18, 19 is achieved by means of this.

The mode of functioning of the former in accordance with the present invention is as follows: in the course of the sequential draw-in of several paper webs 2, 3, 4, 5, or when re-introducing one paper web, for example the paper web 3, the drive mechanisms of the conveyor belts 23 to 26 and 31 to 34 are switched on. At the same time the work cylinders 58 are charged with a pressure medium, so that the conveying rollers 44 of the conveying roller systems 46 to 49 and 51 to 54 act on the conveyor belts 23 to 26 and 31 to 34, or on the previously drawn-in paper webs 2, 4, 5. The paper web 3 is fed to the former 1 via the paper web feed device 61, and in the process comes into the draw-in area of the conveyor belts 23 to 26, 31 to 34, as well as of the conveying roller systems 46 to 49, 51 to 54. These clamp the paper webs 2, 3, 4, 5 and conduct them on the surfaces 10, 38, 39 of the former 1 to the former folding rollers 18, 19 without being backed up.

If necessary, the conveyor belts 23 to 26 can be charged with suction air via the belt guide boxes, the longitudinal slits 42, as well as the holes 28. In the process, the lower paper web 5 of the paper web train 2 to 5 is aspirated. The remaining paper webs 2 to 4 are pressed against the lower paper web 5 by the conveying rollers 44. In the course of this, the conveyor belts 23 to 26, 31 to 41, which are acted upon by suction air, together with the conveying rollers 44, form traction areas, which convey the paper web train 2 to 5, and which also stabilize its direction of running.

In the course of the draw-in process of the paper web, the device in accordance with the present invention can also be switched on in case of web running malfunctions in the paper web feed device, or in case of paper running malfunctions in the folding area. In this case, the conveying rollers are placed on the running paper web and prevent a paper back-up in the paper guide device. Moreover, in case of paper running malfunctions in the folding unit, for example a paper web break during the draw-in process, the paper webs are stabilized in their running direction and cannot drift off laterally.

After the mentioned causes for switching on the device in accordance with the invention have been removed, the conveying rollers 44 will be pivoted back into their position of rest by means of the work cylinders 58, and the conveyor belts 23 to 26, 31 to 34 are stopped. Since the tops of the conveyor belts 23 to 26, 31 to 34 lie slightly below the surfaces 10, 38, 39, they have no contact with one of the paper webs 2, 3, 4 or 5 when the belt drive mechanism has been switched off.

In accordance with another preferred embodiment it is possible to provide the conveying roller systems 46 to 49, 51 to 54 with one motor drive mechanism for each system. It is furthermore also possible to provide each individual conveying roller 44 with a motor drive. The drive mechanisms can be designed to be controllable, so that the circumferential speed of the conveying rollers 44 corresponds to the speed of the conveyor belts 23 to 26, 31 to 34, as well as to the speed of the paper webs 2, 3, 4 or 5.

It is, of course, also possible that a partial paper web of only half the paper web width will need to be drawn in. In that case, either only the left conveyor devices 23, 24, 31, 32, or the right conveyor devices 25, 26, 33, 34, need to be switched on.

In accordance with a further preferred embodiment of the present invention it is possible to form the paper guide device 43, which is arranged over the extended plane 10, only in the area of the deflecting elements 15, 20 of the paper web feed device 61.

Figure 5:
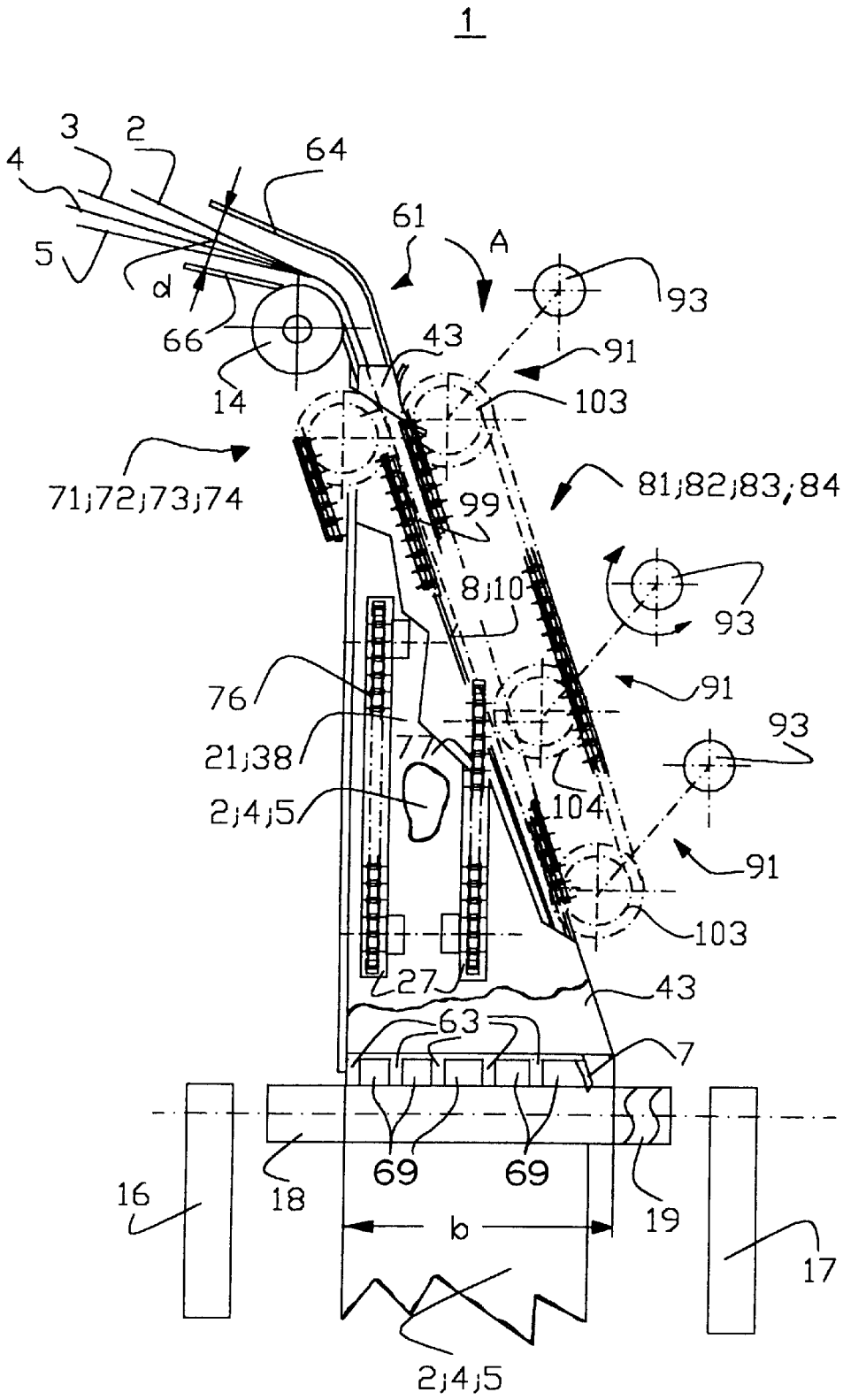
Figure 6:
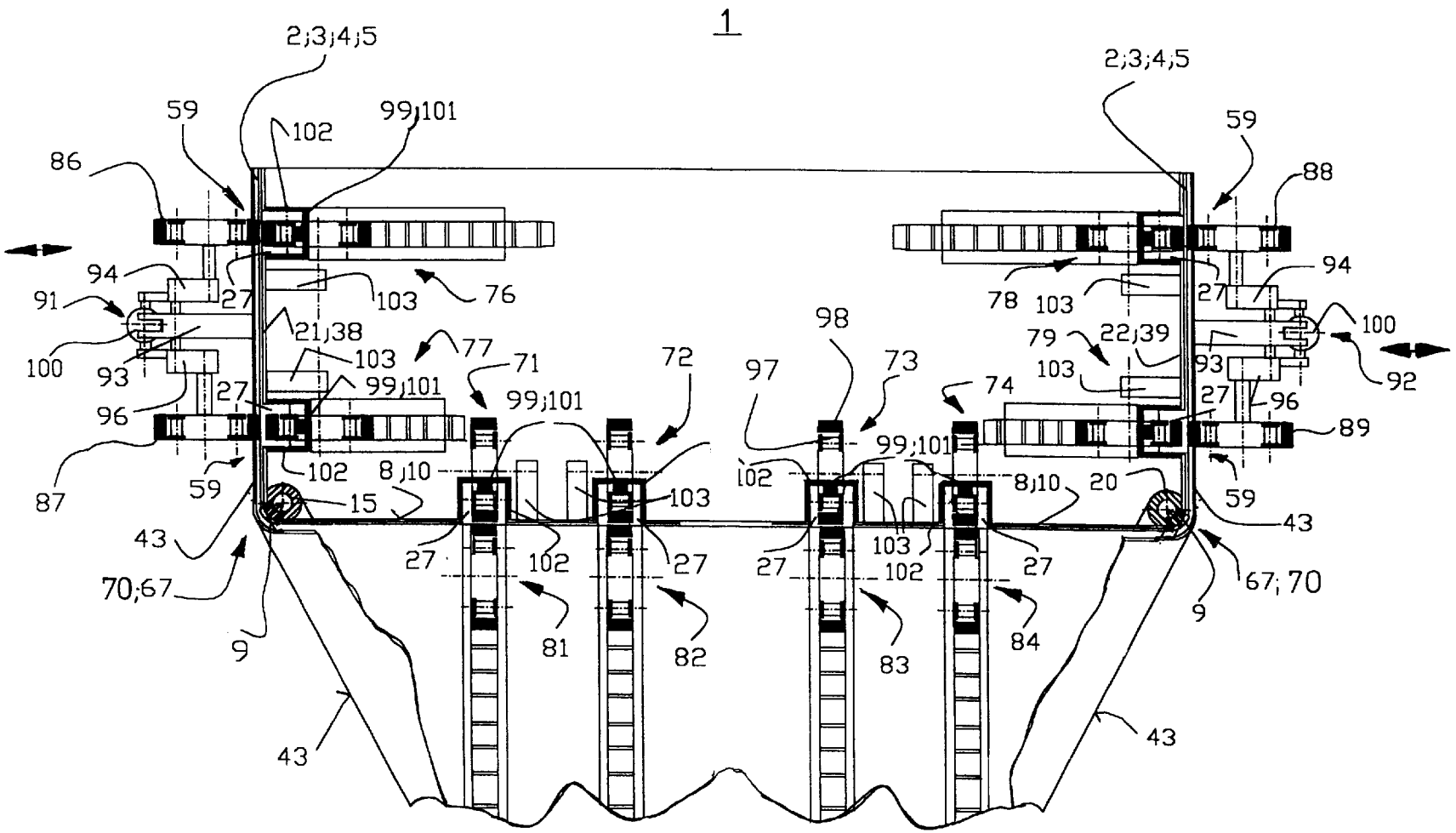

In accordance with another preferred embodiment which is represented in FIGS. 5 and 6, the conveyor belts or conveying devices 71 to 74, 76 to 79, which are arranged on the side of the former plate 8 which is remote from the conduit, or the left and right lateral guide elements 21, 22, consist of endless, driven lower roller chains 71 to 74 and 76 to 79. These lower roller chains 71 to 74 and 76 to 79 work together in pairs with conveying systems 81 to 84, 86 to 89, each arranged on the side of the paper guide device 43 remote from the conduit. These conveying systems 81 to 84, 86 to 89 also consist of roller chains 81 to 84, 86 to 89. All of these roller chains 71 to 74 and 76 to 79 and 81 to 84, 86 to 89 are arranged so that they can be respectively moved in pairs 71, 81, 72, 82, 73, 83, 74, 84, 76, 86, 77, 87, 78, 88, and 79, 89, toward or away from each other, and respectively have deflecting rollers 103 and, if required, support rollers 104. For this purpose, the upper roller chains 81 to 84, 86 to 89, each have actuating devices 91, 92. These actuating devices 91, 92 can support the endless roller chains 86, 87, 88, 89 is pairs, as represented in FIG. 6, and can place them into contact or out of contact. Two two-armed levers 94, 96 are pivotably seated in a support 93 that is fixed in place on the paper guide device. Each first end of the levers 94, 96 is connected with a piston rod of a work cylinder 100 hinged on the support 93. Second ends of the levers 94, 96 support the respective roller chain 86, 87, 88, 89. It is also possible to use several actuating devices 91 or 92 for one or several of the roller chains which are shown in FIG. 5.

Each roller chain 71 to 74, 76 to 79, 81 to 84, and 86 to 89, has engagement elements 97 fixed on the links on the side facing the paper webs 2 to 5, i.e. the paper web contact side. On its paper web contact side, each such engagement element 97 has a coating 98, for example of plastic, with a high coefficient of friction. Note in FIG. 6, the representation on the roller chain 73.

With their sides 99 which respectively extend on the side of the contact with the paper web, i.e. the sides 99 that are close to the conduit, the endless lower roller chains 71 to 74, 76 to 79 are guided on a slide rail 101. The slide rail 101 is maintained in a guide device 102, for example in the shape of a U-shaped profile, fixed in place on the former plate or the lateral plate, wherein the engagement elements 97 with the coating 98 point into the conduit 68 through the slits 27. The lower roller chains 71 to 74, and 76 to 79 are each pivotably seated on holders 103 fixed in place on the former.

It is, of course, also possible to omit the left and right lateral guide elements 21, 22 with the roller chains 76, 86, 77, 87, 78, 88, 79, 89. Then only the pairs of roller chain drive mechanisms 71, 81, 72, 82, 73, 83, and 74, 84, as well as the paper guide device 43, become effective.

If in the course of the paper draw-in process, the roller chains 71 to 74, 76 to 79, 81 to 84, and 86 to 89 circulate by means of drive mechanisms, not represented, and the upper roller chains 81 to 84, and 86 to 89 are moved by means of actuating devices 91, 92 in the direction of the conduit 68, the engagement elements 97 will project through the slits 59 in the paper guide device 43. By means of this, one or several paper webs 2, 3, 4, 5 are held in place between the pairs of roller chains 71, 81, 72, 82, 73, 83, 74, 84, 76, 86, 77, 87, 78, 88, and 79, 89 and are conveyed to the former folding rollers 18, 19 as seen in the work position depicted in FIG. 6. At the end of the paper web draw-in, the upper roller chains are moved back into their position of rest which is shown in FIG. 5. The drive mechanism for all of the roller chains is switched off.

In summary, the concept of the present invention resides in that the conveyor belts 23 to 26, 71 to 74 of the longitudinal former 1 are arranged approximately in the running direction A of the paper webs 2 to 5 below a plane or surface 10 extending between the deflecting elements 15, 20. In the course of this, at least the conveying devices or conveyor belts 23 to 26, and 71 to 74 work together with conveying systems 46 to 49, and 81 to 85, which are arranged above the conveyor belts 23 to 26, and 71 to 74 and which can be brought into contact with the conveyor belts 23 to 26, and 71 to 74. To this end, it is necessary that the former 1 be wholly or at least partially provided with a paper guide device in the area of the running paper webs 2 to 5, which paper guide device is arranged at a distance c above the running paper web.

It is possible to arrange a paper deflecting arrangement 70, spaced apart above each one of the left and right deflecting element 15, 20, for example at a distance c.

The left lateral guide element 21 is bordered by a left, 106, and right, 107, and a lower border 108, for example a frame. The right lateral guide element 22 is also bordered by borders 109, 110, 111.

A conveying path of the respective conveying means 23 to 26, 31 to 34, 44, 71 to 74, and 76 to 79 preferably is designed at least approximately straight and is arranged to extend parallel with the conveying plane of the webs 2, 3, 4, 5.

Thus, the conveying means 23 to 26, 31 to 34, 44, 71 to 74, and 76 to 79; together with the webs 2, 3, 4, 5 they hold extend along a straight line and are therefore embodied as a linear conveyor.

While preferred embodiments of a former in accordance with the present invention have been set forth fully and completely hereinabove, it will be apparent to one of skill in the art that a number of changes in, for example the particular type of printing press used to print the paper webs, the specific support for the former, and the like could be made without departing from the true spirit and scope of the present invention which is accordingly to be limited only by the following claims.

What is claimed is:

1. A former useable to longitudinally fold at least one web, said former comprising:

a former plate having former plate surfaces;

lateral guide elements cooperating with said former plate surfaces;

first driven conveying means arranged within said former and adjacent said former plate surfaces, said first driven conveying means guiding the web parallel with a conveying plane of an unfolded web;

second driven conveying means arranged within said former and adjacent said lateral guide elements, said second driven conveying means conveying the web parallel with said conveying plane and in a conveying direction of the folded web;

third conveying means cooperatively engageable with said first driven conveying means, said third conveying means and said first driven conveying means being supported to be brought into and out of contact with each other, and being selectively driven; and fourth conveying means cooperatively engageable with said second driven conveying means, said fourth conveying means and said second driven conveying means being supported to be brought into and out of contact with each other and being selectively driven.

2. The former of claim 1 wherein said conveying planes of said first and second driven conveying means are approximately vertical with respect to each other.

3. The former of claim 1 wherein a plurality of webs placed on top of each other are longitudinally folded.

4. The former of claim 1 wherein said first driven conveying means are linear conveyors selected from the group including conveyor belts, chains and straps.

5. The former of claim 1 further including means to grip an end portion of a web in said first and second driven conveying means.

6. The former of claim 1 wherein said former has former lateral borders and further including paper deflecting arrangements surrounding said former lateral borders and spaced from said former lateral borders as a shell.

7. The former of claim 1 further including a paper guide device, said paper guide device being spaced from, and at least partially covering said former plate surfaces.

8. The former of claim 1 wherein said third conveying means is positioned outside of said former plate and further wherein said fourth conveying means is positioned outside of said lateral guide elements.

9. The former of claim 1 further including a speed-controlled drive motor for said first driven conveying means.

* * * * *